US010087681B2

(12) United States Patent
Lin et al.

(10) Patent No.: US 10,087,681 B2
(45) Date of Patent: Oct. 2, 2018

(54) WINDOW WITH BUILT-IN FOLDABLE SCREEN, AND WINDOW FRAME ASSEMBLY THEREOF

(71) Applicant: TAROKO DOOR & WINDOW TECHNOLOGIES, INC., Gaoxiong (CN)

(72) Inventors: Dinghui Lin, Gaoxiong (CN); Zhiyuan Zhang, Gaoxiong (CN)

(73) Assignee: TAROKO DOOR & WINDOW TECHNOLOGIES, INC., Gaoxiong (TW)

( * ) Notice: Subject to any disclaimer, the term of this patent is extended or adjusted under 35 U.S.C. 154(b) by 0 days.

(21) Appl. No.: 15/305,939

(22) PCT Filed: Apr. 21, 2014

(86) PCT No.: PCT/CN2014/075821

§ 371 (c)(1),
(2) Date: Oct. 21, 2016

(87) PCT Pub. No.: WO2015/161412

PCT Pub. Date: Oct. 29, 2015

(65) Prior Publication Data

US 2017/0051558 A1 Feb. 23, 2017

(51) Int. Cl.
*E06B 3/48* (2006.01)
*E06B 9/52* (2006.01)
(Continued)

(52) U.S. Cl.
CPC ..... *E06B 9/52* (2013.01); *E05D 15/26* (2013.01); *E06B 1/32* (2013.01); *E06B 1/36* (2013.01);
(Continued)

(58) Field of Classification Search
CPC . E06B 9/52; E06B 9/522; E06B 9/367; E06B 9/362; E06B 9/54; E06B 9/58;
(Continued)

(56) References Cited

U.S. PATENT DOCUMENTS

| | | | | |
|---|---|---|---|---|
| 5,456,303 | A | 10/1995 | Horinouchi | |
| 6,371,188 | B1 * | 4/2002 | Baczuk | E06B 1/70 160/92 |
| 8,082,969 | B2 * | 12/2011 | Okachi | E06B 9/262 160/84.03 |
| 8,176,961 | B2 | 5/2012 | Pelekanos | |
| 2007/0199667 | A1 * | 8/2007 | Jumbeck | A47H 99/00 160/274 |
| 2007/0267152 | A1 * | 11/2007 | Fan | E06B 9/262 160/84.06 |
| 2010/0319861 | A1 * | 12/2010 | Pelekanos | E06B 9/262 160/378 |

(Continued)

FOREIGN PATENT DOCUMENTS

| | | | |
|---|---|---|---|
| CN | 2594439 | Y | 12/2003 |
| CN | 201865500 | U | 6/2011 |

(Continued)

*Primary Examiner* — Katherine W Mitchell
*Assistant Examiner* — Johnnie A. Shablack
(74) *Attorney, Agent, or Firm* — Muncy, Geissler, Olds & Lowe, P.C.

(57) ABSTRACT

A window frame assembly has a built-in foldable screen, having a body, the body having at least a first frame part and a second frame part; the first frame part has at least a first end surface and a second end surface; the second end surface is fixedly connected to the second frame part; the first end surface is provided with a protruded guiding convex part; the guiding convex part is provided with a line receiving groove; and two sides of the line receiving groove are respectively provided with a concave part. The above structure has the benefits of enabling the guiding convex part located on the transverse frame in the foldable screen module to be re-assembled on the structure of the window frame assembly, thus reducing the number of foldable screen module components, and also improving the convenience of assembling the foldable screen module in the window.

8 Claims, 5 Drawing Sheets

(51) Int. Cl.

| | |
|---|---|
| ***E05D 15/26*** | (2006.01) |
| ***E06B 1/32*** | (2006.01) |
| ***E06B 1/36*** | (2006.01) |
| ***E06B 3/46*** | (2006.01) |
| *E06B 9/54* | (2006.01) |

(52) U.S. Cl.
CPC ..... *E06B 3/4609* (2013.01); *E06B 3/48* (2013.01); *E06B 9/522* (2013.01); *E05Y 2900/148* (2013.01); *E06B 2009/527* (2013.01); *E06B 2009/528* (2013.01); *E06B 2009/543* (2013.01)

(58) Field of Classification Search
CPC ..... E06B 9/36; E06B 9/262; E06B 2009/587; E06B 2009/583; E06B 2009/543; E06B 2009/527; E06B 2009/528; E06B 3/48; E06B 1/32
USPC ..... 160/84.06, 90
See application file for complete search history.

(56) References Cited

U.S. PATENT DOCUMENTS

| | | | | |
|---|---|---|---|---|
| 2015/0007502 | A1* | 1/2015 | Poppema ..... | E06B 9/522 49/469 |
| 2017/0051558 | A1* | 2/2017 | Lin ..... | E06B 9/52 |

FOREIGN PATENT DOCUMENTS

| | | | |
|---|---|---|---|
| CN | 201865502 | U | 6/2011 |
| CN | 202325015 | U | 7/2012 |
| CN | 102359327 | B | 4/2013 |
| EP | 2549053 | A1 * | 1/2013 |
| EP | 2599948 | A1 * | 6/2013 |
| EP | 3064701 | A1 * | 9/2016 |
| KR | 20060017478 | A | 2/2006 |
| TW | M370003 | U | 12/2009 |
| TW | 201122207 | A | 7/2011 |

* cited by examiner

WINDOW WITH BUILT-IN FOLDABLE SCREEN, AND WINDOW FRAME ASSEMBLY THEREOF

FIELD OF THE INVENTION

The present invention relates to a window, and more particularly to a window structure with a built-in foldable screen.

BACKGROUND OF THE INVENTION

According to the prior art, foldable screens would be entirely disposed in many present window structures, and an opening of the window is opened or closed by an extension or a storage of the foldable screen, thereby achieving benefits of air circulation, preventing external insects from entering into a room, and so on. Therefore, most of the present ways to install the foldable screens in the window structures use two kinds of ways which are plug-in and built-in, wherein the way of plug-in is mainly to directly screw and fix a foldable screen structure to an outer side of the window by using a plurality of screwing fixed components. However, this method of mounting a plug-in foldable screen often gives an uncoordinated viewing feeling for people in appearance, thereby having a huge effect on a product appearance. Therefore, many present window structures are chosen to be placed inside the window, so as to improve a shortcoming of the window plug-in foldable screen.

Therefore, a method of placing the foldable screen inside the window structure is to directly install the conventional foldable screen structure into the window. However, this kind of direct installation has an installation difficulty due to an interference phenomenon often induced by a foldable screen outer frame and a window outer frame. Further, even if an opening size of the window is enlarged for enabling the convenient installation of the foldable screen into the window, this kind of configuration has a circumstance that the foldable screen cannot be hidden in the window upon performing the storage. Therefore, the incoordination of the appearance is also induced. Thus, a tendency is gradually developed recently to completely hide the foldable screen inside the window after performing the storage. For example, TW370003, CN201020606856.0, CN201110208998.0, CN201120490710.9, and so on. However, these patent technologies still directly install a foldable screen structure into the window structure. However, during a transporting process of a whole foldable screen, the problems of the foldable screen component being easily hit and damaged so as to seriously affect the product quality, an assembling difficulty, and so on are induced.

SUMMARY OF THE INVENTION

A primary object of the present invention is to provide a window frame assembly with a built-in foldable screen, which mainly changes a guiding convex portion of two horizontal frames in an original foldable screen module to be disposed on a frame assembly structure of a window. Thus, besides a benefit of reducing the number of foldable screen module components, a substantive effect of faster installation of the foldable screen into the window is achieved.

Another primary object of the present invention is to provide a window frame assembly with a built-in foldable screen. Because the present invention has the benefit of reducing the number of foldable screen module components for installing the foldable screen module into a window, the installing difficulty, which is induced by the interference phenomenon produced by placing a whole foldable screen into the window in prior art, can be overcome. Further, the circumstance of the foldable screen component being hit and damaged is prevented from occurring.

A technical solution of the present invention is a window frame assembly with a built-in foldable screen, comprising a body, wherein a guiding convex portion is protruded from a side surface of the body, and a line receiving groove is formed in the guiding convex portion.

A window frame assembly with a built-in foldable screen comprises a body at least having a first frame portion and a second frame portion, wherein the first frame portion at least has a first end surface and a second end surface; and the second end surface is fixedly connected to the second frame portion, wherein a guiding convex portion is protruded from the first end surface of the first frame portion, and a line receiving groove is formed in the guiding convex portion.

A window with a built-in foldable screen comprises an outer frame and a foldable screen module, wherein the outer frame at least has two frame components, a side frame component connected with an end of the two frame components, and at least one window plate; and wherein the foldable screen module is disposed in the outer frame and adjacent to the window plate, and the foldable screen module at least has a first frame, a foldable screen and at least one screen line; wherein two ends of the first frame is slidably moved between the two frame components, and the foldable screen is disposed between the first frame and the side frame component of the outer frame, and the screen line passes through the foldable screen, extends into the first frame and/or the side frame component of the outer frame, and then extends into the two frame components of the outer frame.

A beneficial effect of the present invention is that: the present invention provides a window frame assembly with a built-in foldable screen, comprising a body, wherein a guiding convex portion is protruded from a side surface of the body, and a line receiving groove is formed in the guiding convex portion.

Further, the present invention also provides a window with a built-in foldable screen, comprising an outer frame and a foldable screen module, wherein the outer frame at least has two frame components, the two frame components of the outer frame distantly face each other, each of the opposite end surfaces of the two frame components is formed with a guiding convex portion, a line receiving groove is formed in the guiding convex portion, and at least one window plate is disposed between the two frame components; and wherein the foldable screen module is disposed in the outer frame and adjacent to the window plate, and the foldable screen module at least has two upright frames, a foldable screen and at least one screen line; wherein the at least one of the upright frame is slidably moved between the guiding convex portions of the two frame components, and the foldable screen is disposed between the two upright frames and passes from the upright frame into the line receiving groove of the guiding convex portion.

DETAILED DESCRIPTION OF THE PREFERRED EMBODIMENTS

Figure 1:
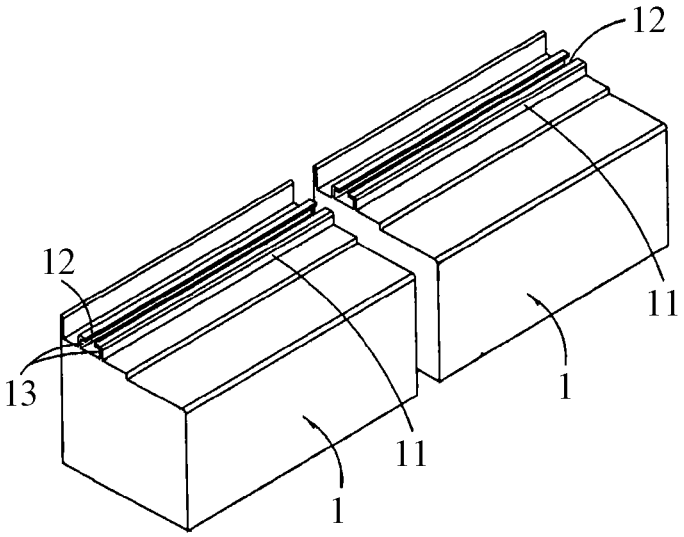
FIG. 1 is a schematic diagram of a window frame assembly according to a preferred embodiment of the present invention.

Please refer to FIG. 1. A window frame assembly according to a preferred embodiment of the present invention mainly comprises a body 1, wherein a guiding convex portion 11 is protruded from a side surface of the body 1, a line receiving groove 12 is formed in the guiding convex portion 11, and each of two sides of the line receiving groove 12 is formed with a concave portion 13.

Figure 2:
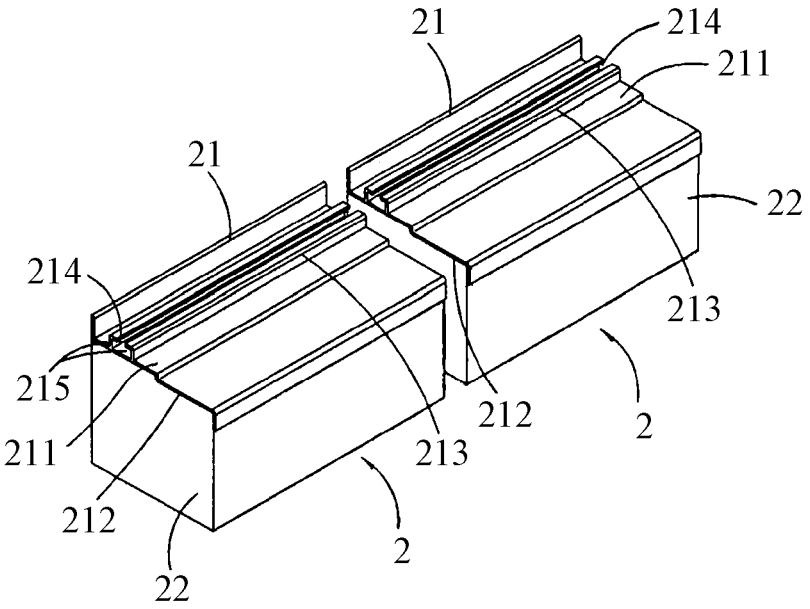
FIG. 2 is a three-dimensional schematic diagram of a window frame assembly according to another preferred embodiment of the present invention.
Figure 3:
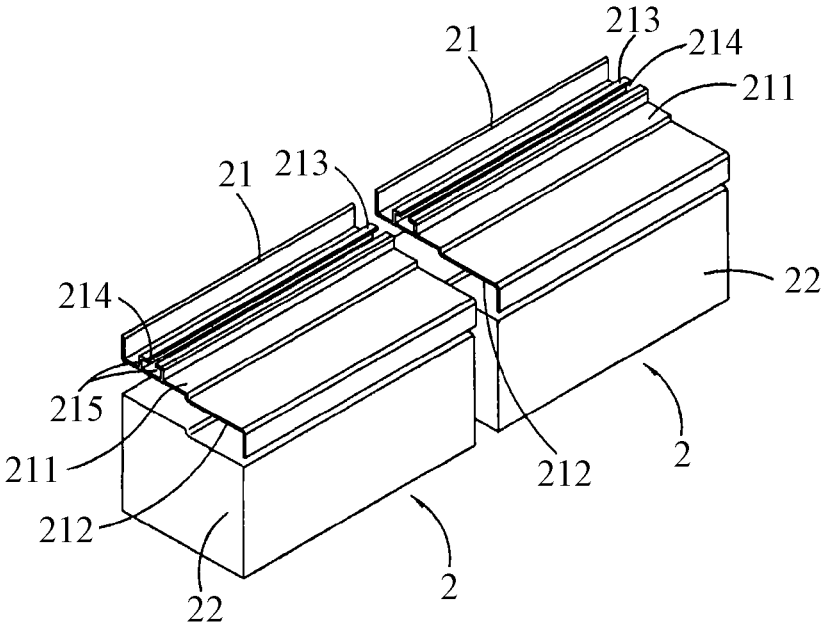
FIG. 3 is a three-dimensional exploded schematic diagram of a window frame assembly according to another preferred embodiment of the present invention.
Figure 4:
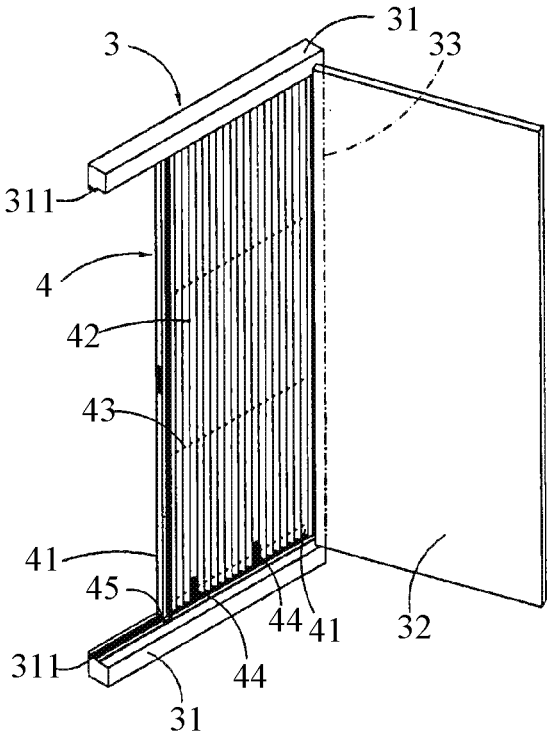
FIG. 4 is a schematic diagram of a window with a built-in foldable screen according to a preferred embodiment of the present invention.

Please refer FIG. 2 and FIG. 3. A window frame assembly with a built-in foldable screen according to another preferred embodiment of the present invention is shown and comprises: a body 2 at least having a first frame portion 21 and a second frame portion 22, wherein the first frame portion 21 at least has a first end surface 211 and a second end surface 212; and the second end surface 212 is fixedly connected to the second frame portion 22, wherein a guiding convex portion 213 is protruded from the first end surface 211 of the first frame portion 21, a line receiving groove is formed in the guiding convex portion 213, and each of two sides of the line receiving groove 214 is formed with a concave portion 215.

From above, the present invention can change a guiding convex portion of two horizontal frames in an original foldable screen module to be disposed on a frame assembly structure of a window. Thus, besides a benefit of reducing the number of foldable screen module components, substantive effects, such as the convenience of assembling the foldable screen module in the window and so on, are also improved.

Please refer to FIG. 4 to FIG. 8. A window with a built-in foldable screen according to another preferred embodiment of the present invention is shown and comprises: an outer frame 3 and a foldable screen module 4, Wherein the outer frame 3 is configured to be disposed in an opening (not shown) of a building, and the outer frame 3 at least has two frame components 31 and a side frame component 33 connected with an end of the two frame components 31 (shown as an imaging line in FIG. 4), wherein the two frame components 31 distantly face each other, each of opposite end surfaces of the two frame components 31 is formed with a guiding convex portion 311, a line receiving groove 312 is formed in the guiding convex portion 311, each of two sides of the line receiving groove 312 is formed with a concave portion 313, and at least one window plate 32 is disposed between two frame components 31. In the present embodiment, the two frame components 31 and the side frame component 33 are respectively two horizontal frames and an upright frame.

Figure 6:
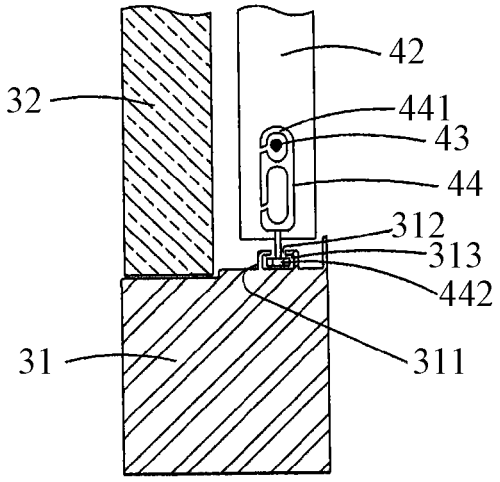
FIG. 6 is a schematic diagram of a windproof hook in a window with a built-in foldable screen hooking at a screen line and in a concave portion of an outer frame according to the present invention.

The foldable screen module 4 is disposed in the outer frame 3 and adjacent to the window plate 32, and the foldable screen module 4 at least has a first frame 41, a foldable screen 42, at least one screen line 43 and at least one windproof hook 44; wherein the first frame 41 is slidably moved between the guiding convex portions 311 of the two frame components, and the foldable screen 42 is disposed between the first frame 41 and the side frame component 33 of the outer frame 31, and the screen line 43 passes through the foldable screen 42, extends into the first frame 41 and/or the side frame component 33 of the outer frame 31, and then extends into the line receiving groove 312 of the guiding convex portion 311 of the two frame components 31 of the outer frame 31. Two ends of the windproof hook 44 are respectively formed with a hook portion 441 and a base 442, wherein the base 442 is configured to hook on the screen line 43 (as shown in FIG. 6), and the base 441 is configured to slidably move in the concave portion 313 of the guiding convex portion 311 of the outer frame 31, such that no lifting is induced upon the foldable screen 42 being blew by wind.

Figure 5A:
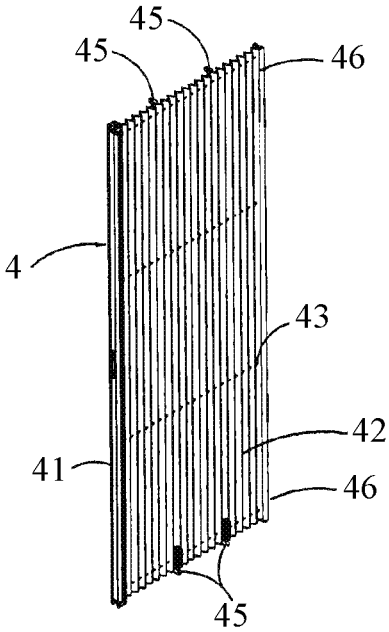
FIG. 5A is a schematic diagram of adding a second frame in a foldable screen module according to the present invention.
Figure 5B:
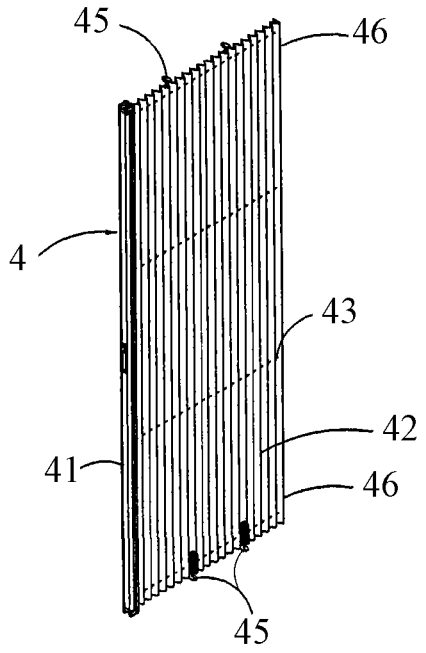
FIG. 5B is a schematic diagram of a second frame of a foldable screen module according to another implementing aspect of the present invention.

Please refer to FIG. 5A and FIG. 5B. The foldable screen module 4 further comprises a second frame 46 mounted on the side frame component 31 of the outer frame 3, and the foldable screen 42 of the foldable screen module 4 is changed to be disposed between the first frame 41 and the second frame 46. The screen line 43 passes through the foldable screen 42, extends into the first frame 41 and/or the second frame 46, and then extends into the line receiving groove 312 of the guiding convex portion 311 of the two frame components 31 of the outer frame 31. Further, the second frame 46 can be one of an aluminum extrusion frame (as shown in FIG. 5A) or a PVC frame (as shown in FIG. 5B).

Figure 7:
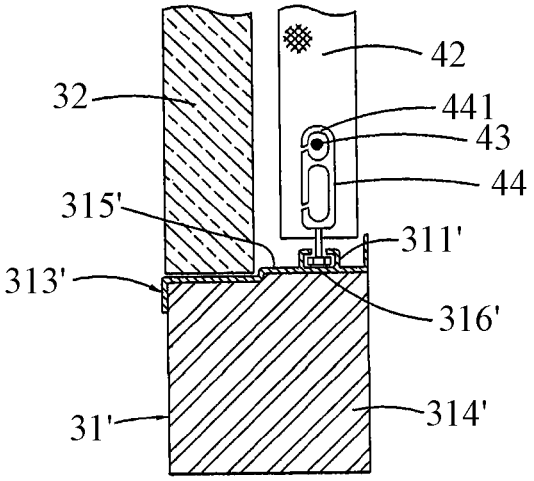
FIG. 7 is a schematic diagram of a frame component in a window with a built-in foldable screen according to another implementing aspect of the present invention.

Please refer to FIG. 7. The guiding convex portion 311 of the frame component 31 of the present embodiment can be integrated. In another implementing aspect, the frame component 31' at least has a first frame portion 313' and a second frame portion 314', wherein the first frame portion 313' at least has a first end surface 315' and a second end surface 316'; and the second end surface 316' is fixedly connected to the second frame portion 314', wherein the guiding convex portion 311' is protruded from the first end surface 315' of the first frame portion 313'.

Figure 8:
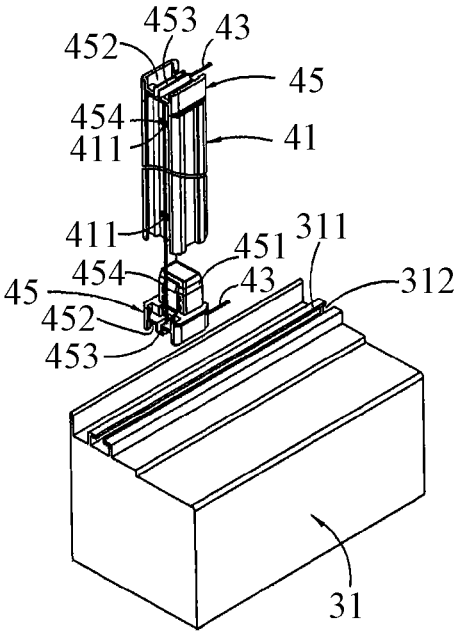
FIG. 8 is a schematic diagram of a guiding block of an upright frame to assemble on a guiding convex portion of an outer frame in a window with a built-in foldable screen according to another implementing aspect of the present invention.

Please refer to FIG. 8. Each of two ends of the first frame 41 is formed with a guiding block 45, and each of the guiding blocks at least has an insert-to-fix element 451, a sliding groove 452, and a turning groove 453 wherein the insert-to-fix element 451 is configured to insert and fix into an opening (not shown) in an end of the upright frame 41. Further, a hook portion 454 is formed on an outer edge of the insert-to-fix element 451, and the first frame material 41 and the second frame 46 (as shown in FIG. 5A or FIG. 5B) are formed with a fixation hole 411 at a place which is corresponding to the hook portion 454 of the guiding block, so as to be fixedly connected together as a whole body by the hook portion 454 being stuck in the fixation hole 411 of the first frame 41. Therefore, no separation is induced. Further, the sliding groove 452 is configured to be disposed across and over an outer edge of the guiding convex portion 311 of the frame component 31, such that the guiding block 45 of the first frame 41 can be slidably moved in a fixed direction without deviation by a guiding of the guiding convex portion 311. Further, the turning groove 453 is formed and opposite to the line receiving groove 312 of the guiding convex portion 311 of the frame component 31, such that the screen line 43 on the first frame 41 can enter into the line receiving groove 312 by a turning of the turning groove 453. When the first frame 41 is slidably moved on the guiding convex portion 311, the screen line 43 is exactly received in the line receiving groove 312, and no damage is caused due to friction.

From above, because no horizontal frame is disposed in the foldable screen module 4, the benefits of reducing the component number of the foldable screen module 4 and decreasing the cost are achieved. Further, when the foldable screen module 4 is installed in an outer frame 3, the benefit of enabling a fast installation is achieved due to no interference of the horizontal frame. Also, circumstances such as the foldable screen being hit and damaged can be avoided. Further, the window indicated in the present invention can be one of a push-out window, a pull-in window, a horizontally pulled window, an upward tilted window or a downward dumped window. Further, the foldable screen module is also not limited to be disposed in an outdoor side or an indoor side of the window.

The above descriptions are only preferred embodiments of the present invention but are not used to limit the features of the present invention. As long as a reinvention uses technical means or creation principles related to the present invention, the reinvention still falls within the scope of the invention. One skilled in the art, without departing from the spirit and scope of the invention, can make various modifications and variations, so it is reasonable that the range of the scope of the invention is defined by the claims.

What is claimed is:

1. A window with a built-in foldable screen, comprising an outer frame and a foldable screen module, wherein the outer frame at least has two frame components, a side frame component connected with an end of the two frame components, and at least one window plate, wherein each of end surfaces of the two frame components is formed with a guiding convex portion, and a line receiving groove is formed in the guiding convex portion, wherein each of two ends of the first frame is formed with a guiding block, and each of the guiding blocks at least has an insert-to-fix element and a sliding groove, wherein the insert-to-fix element is configured to insert and fix into an opening in an end of the first frame; and the sliding groove is configured to be disposed across and over the guiding convex portion of the frame component, and wherein the foldable screen module is disposed in the outer frame and adjacent to the window plate, and the foldable screen module at least has a first frame, a foldable screen and at least one screen line, and wherein two ends of the first frame are slidably moved between the two frame components, and the foldable screen is disposed between the first frame and the side frame component of the outer frame, and the screen line passes through the foldable screen, extends into the first frame and/or the side frame component of the outer frame, and then extends into the two frame components of the outer frame.

2. The window with the built-in foldable screen according to claim 1, wherein each of two sides of the line receiving groove is formed with a concave portion.

3. The window with built-in foldable screen according to claim 1, wherein the foldable screen module further comprises a second frame mounted on the side frame component of the outer frame, and the foldable screen of the foldable screen module is changed to be disposed between the first frame and the second frame.

4. The window with the built-in foldable screen according to claim 3, the second frame of the foldable screen module is one of an aluminum extrusion frame or a PVC frame.

5. The window with the built-in foldable screen according to claim 1, wherein the two frame components and the side frame component of the outer frame are respectively two horizontal frames and an upright frame of the outer frame.

6. The window with the built-in foldable screen according to claim 1, wherein each of the frame components at least has a first frame portion and a second frame portion, the first frame portion at least has a first end surface and a second end surface; the second end surface is fixedly connected to the second frame portion; and the guiding convex portion is formed on the first end surface of the first frame portion.

7. The window with the built-in foldable screen according to claim 1, wherein the guiding block further comprises a turning groove opposite to the line receiving groove of the guiding convex portion of the frame component.

8. The window with the built-in foldable screen according to claim 1, wherein a hook portion is formed on the insert-to-fix element, and the first frame material is formed with a fixation hole corresponding to the hook portion.

* * * * *